US011224889B1

(12) United States Patent
Cadkin et al.

(10) Patent No.: US 11,224,889 B1
(45) Date of Patent: Jan. 18, 2022

(54) FLUID DISPENSING APPARATUS AND METHOD

(71) Applicant: Sani-Spire Corp., Joliet, IL (US)

(72) Inventors: Steve Cadkin, Joliet, IL (US); Mike Zambon, New Lenox, IL (US)

(73) Assignee: Sani-Spire Corp., Joliet, IL (US)

( * ) Notice: Subject to any disclaimer, the term of this patent is extended or adjusted under 35 U.S.C. 154(b) by 0 days.

(21) Appl. No.: 17/218,530

(22) Filed: Mar. 31, 2021

Related U.S. Application Data

(63) Continuation-in-part of application No. 29/771,453, filed on Feb. 23, 2021.

(51) Int. Cl.
*B05B 12/00* (2018.01)
*A47K 5/12* (2006.01)

(52) U.S. Cl.
CPC ..... *B05B 12/002* (2013.01); *A47K 5/1202* (2013.01)

(58) Field of Classification Search
CPC ..... B05B 12/002; A47K 5/1202
USPC ..... 222/186
See application file for complete search history.

(56) References Cited

U.S. PATENT DOCUMENTS 1,061,099 A 5/1913 Miller
1,172,406 A 2/1916 Taylor
1,676,851 A * 7/1928 Bloodhart ..... A47K 5/1205 222/168
1,736,392 A 11/1929 Coss et al.
1,947,086 A * 2/1934 Hillyard ..... A47K 5/1214 222/129
1,949,315 A 2/1934 Levemier
2,103,687 A * 12/1937 McKenney ..... A47K 5/1211 222/179
2,456,958 A 12/1948 Kretschmer
2,628,744 A * 2/1953 Mowbray ..... A47K 5/1211 222/179
3,203,597 A * 8/1965 Birch ..... A47K 5/1204 222/179
3,233,787 A * 2/1966 Ross ..... A47K 5/1205 222/179
3,457,573 A 7/1969 Patyna et al.
(Continued)

FOREIGN PATENT DOCUMENTS

DE 202020101674 U1 4/2020
DE 202020001634 U1 5/2020
(Continued)

OTHER PUBLICATIONS

MaxMPF, LG-M27 Foot-operated Gel Column Soap Sanitizer Pedal Foot Pump Dispenser, web page, [retrieved on Jan. 2021], pp. 1-4, MaxMPF, Retrived from the Internert <URL: https://www.maxmpf.com/products/lg-m27-foot-operated-gel-column-soap-sanitizer-pedal-foot-pump-dispenser/>.
(Continued)

*Primary Examiner* — Vishal Pancholi
(74) *Attorney, Agent, or Firm* — Nyman IP LLC; Scott Nyman

(57) ABSTRACT

A fluid dispensing apparatus is provided for dispensing fluids and objects without requiring use of hands. The fluid dispensing apparatus may include a body, footing, pedal, actuation rod, platform, dispensing object, container, container lid, sign member, and bolt. A method for dispensing fluids and objects without requiring use of hands using the fluid dispensing apparatus is also provided.

18 Claims, 5 Drawing Sheets

(56) References Cited

U.S. PATENT DOCUMENTS

| | | | | |
|---|---|---|---|---|
| 3,897,890 | A * | 8/1975 | Jente | F04B 45/02 222/179 |
| 4,861,079 | A | 8/1989 | DeForrest, Sr. | |
| 4,928,375 | A | 5/1990 | Hadaway | |
| 5,447,044 | A | 9/1995 | Cheng | |
| 5,730,567 | A | 3/1998 | Haseley et al. | |
| 5,799,841 | A * | 9/1998 | Wirt | A47K 5/1207 141/119 |
| 5,996,851 | A * | 12/1999 | Dolan | A47K 5/1209 222/179 |
| 6,367,662 | B1 * | 4/2002 | Dorman | A47K 5/1211 222/179 |
| 7,165,924 | B1 | 1/2007 | Breslin et al. | |
| 7,299,951 | B2 | 11/2007 | Jahnke et al. | |
| D563,705 | S | 3/2008 | Binderbauer et al. | |
| D671,346 | S | 11/2012 | Zlatic et al. | |
| 8,388,294 | B2 | 3/2013 | Lanneree | |
| D730,077 | S | 5/2015 | Watson et al. | |
| 9,157,549 | B2 | 10/2015 | Ashby | |
| D812,395 | S | 3/2018 | Buell et al. | |
| D812,928 | S | 3/2018 | Buell et al. | |
| D814,208 | S | 4/2018 | Mann | |
| D815,454 | S | 4/2018 | Mann | |
| 9,945,413 | B2 | 4/2018 | Rice | |
| D818,739 | S | 5/2018 | Buell et al. | |
| 10,406,590 | B2 | 9/2019 | Hutter, III | |
| D885,665 | S | 5/2020 | Richter et al. | |
| 2012/0187146 | A1 | 7/2012 | Chopra | |
| 2012/0225408 | A1 | 9/2012 | Moore | |
| 2016/0061246 | A1 | 3/2016 | Campbell | |

FOREIGN PATENT DOCUMENTS

| | | | |
|---|---|---|---|
| DE | 202020102318 | U1 | 5/2020 |
| DE | 202020002169 | U1 | 6/2020 |
| DE | 202020102603 | U1 | 6/2020 |
| DE | 202020105019 | U1 | 9/2020 |
| EP | RCD002483016-0001 | | 6/2014 |
| ES | 1022618 | | 5/1993 |
| IN | 331430-002-0001 | | 8/2020 |
| IN | 330783-001-0001 | | 9/2020 |
| IN | 332953-001-0001 | | 10/2020 |
| IN | 334501-001-0001 | | 11/2020 |

OTHER PUBLICATIONS

Swach Canada, NAL—Pedal Operated Hand Sanitizer Dispenser, web page, [retrieved on Jan. 2021], pp. 1-4, Swach Canada, Retrieved from the Internet <URL: https://swach-canada.com/products/nal-pedal-operated-hand-sanitizer-dispenser?variant=35240110653604&utm_medium=cpc&utm_source=google&utm_campaign=Google%20Shopping&currency=CAD&gclid=EAlalQobChMlhsXyoKTL7glVUtbACh1alAWJEAQYAyABEgLCN_D_BwE>.

GLOBAL Industrial, Shield Foot Pedal Activated Hand Sanitizer Stand, web page, [retrieved on Jan. 2021], pp. 1-2, GLOBAL Industrial, Retrieved from the Internet <URL: https://www.globalindustrial.com/p/janitorial-maintenance/bathroom/hand-sanitizers/shield-dispenser-foot-pedal-activated-hand-sanitizer-stand?infoParam.campaignId=T9F&gclid=EAlalQobChMlhsXyoKTL7glVUtbACh1alAWJEAkYAyABEglJrfD_BwE>.

Home Depot, OX Tools Hand Sanitizer Dispenser, Touchless Pedal Activated Stand, 100% Mechanical—No Batteries or Power Needed, web page, [retrieved on Jan. 2021], pp. 1-3, Home Depot, Retrieved from the Internet <URL: https://www.homedepot.com/p/OX-Tools-Hand-Sanitizer-Dispenser-Touchless-Pedal-Activated-Stand-100-Mechanical-No-Batteries-or-Power-Needed-OX-SANST-PEDESTALUS/314280180>.

WB Mason, Germs Be Gone® Hand Sanitizer Dispensing Floor Stand, Foot Pedal, Stainless Steel, web page, [retrieved on Jan. 2021], pp. 1-2, WB Mason, Retrieved from the Internet <URL: https://www.wbmason.com/ProductDetail.aspx?ItemDesc=Germs-Be-Gone-Hand-Sanitizer-Dispensing-Floor-Stand-Foot-Pedal-Stainless-Steel&ItemID=GBGPEDALSTANDSS&uom=EA>.

The Daily Moss, Introducing Sani-Spire: The Touchless Foot Operated Hand Sanitizer Dispensing Station, web page, Jul. 18, 2020, pp. 1-4, The Daily Moss, Retrieved from the Internet <URL: https://www.dailymoss.com/introducing-sani-spire-the-touchless-foot-operated-hand-sanitizer-dispensing-station/>.

Sani-Spire, Sani-Spire Foot Operated Standing Hand Sanitizer Dispenser with Sign, web page, [retrieved on Jan. 2021], pp. 1-11, Sani-Spire, Retrieved from the Internet <URL: https://sanispire.com/products/sani-spire-foot-operated-hand-sanitizer-dispensing-station?variant=34657681834139 8currency=USD&utm_medium=product_sync&utm_source=google&utm_content=sag_organic&utm_campaign=sag_organic&gclid=EAlalQobChMlhsXyoKTL7glVUtbACh1alAWJEAQYAiABEgJFhvD_BwE >.

Furnitubes, Zenith Foot Pedal Dispenser,web page, [retrieved on Jul. 2020], pp. 1-3, Furnitubes International Ltd., Retrieved from the Internet <URL: https://www.furnitubes.com/street-furniture/zenith-foot-pedal-sanitiser-dispenser>.

TerraBoost, TerraBoost Sani-Step, web page, [retrieved on Jul. 2020], TerraBoost, Retrieved from the Internet <URL: https://shop.terraboost.com/products/foot-pedal?variant=31689960128579&currency=USD&utm_medium=product_sync&utm_source=google&utm_content=sag_organic&utm_campaign=sag_organic&utm_campaign=gs-2020-03-17&utm_source=google&utm_medium=smart_campaign_&gclid=CjwKCAjwjLD4BRAiEiwAg5NBFtjlakYEz7ffYvibxAyEr1LXYrOnVo_JaBk-weXO1sNwMv90Z0hsOhoCjGgQAvD_BwE>.

Cobus-Spaces, Ilona Foot Pump Dispenser, web page, [retrieved on Jul. 2020], pp. 1-5, Cobus Spaces, Retrieved from the Internet <URL: https://cobus-spaces.com/product/ilona-sanitiser-foot-pump-dispenser/>.

Lafferty Equipment, Sentry Dispenser, web page, [retrieved on Jul. 2020], pp. 1-3, Lafferty Equipment Manufacturing, Inc., Retrieved from the Internet <URL: https://www.laffertyequipment.com/products/976906>.

Moroni Safety, Moroni Safety, web page, [retrieved on Jul. 2020], 1 page, Moroni Safety, Retrieved from the Internet <URL: https://www.moronisafety.com/en/sanitizer-dispenser-and-sanitizing-gels/68-foot-pedal-hand-sanitizer-dispenser-stainless-steel/>.

Reddit, Reddit Dispenser, web page, [retrieved on Jul. 2020], pp. 1-6, Reddit, Retrieved from the Internet <URL: https://www.reddit.com/r/specializedtools/comments/ggf4y3/foot_pedal_operated_dispenser_for_hand_sanitiser/>.

Weber Scientific, EZ Step, web page, [retrieved on Jul. 2020], 1 page, Weber Scientific, Retrieved from the Internet <URL: https://www.weberscientific.com/ez-step-foot-activated-hand-sanitizer-dispenser-best-sanitizers>.

M Ramakrishnan, Businesses coming up with innovativeproducts for post-Covid world, web page, Apr. 30, 2020, pp. 1-6, The HINDU BusinessLine, Retrieved from the Internet <URL: https://www.thehindubusinessline.com/companies/msme/businesses-coming-up-with-innovative-products-for-post-covid-world/article31472821.ece#>.

* cited by examiner

FLUID DISPENSING APPARATUS AND METHOD

CROSS-REFERENCE TO RELATED APPLICATION

This application claims the priority from U.S. design patent application Ser. No. 29/771,453 filed Feb. 23, 2021. The foregoing application is incorporated in its entirety herein by reference.

FIELD OF THE INVENTION

The present disclosure relates to a fluid dispensing apparatus. More particularly, the disclosure relates to dispensing fluids and objects without requiring use of hands.

BACKGROUND

As users interact with objects in the world, they inherently come in contact with germs, viruses, bacteria, pathogens, and other undesirable substances. To counter this undesirous risk to health and wellbeing, users often wash their hands and/or sanitize with an alcohol-based or other antibacterial and anti-disinfectant sanitizer solution. However, operating a sanitizer distributing bottle inherently exposes the user to contacting another surface also contacted by other members of the public—the sanitizer dispenser pump.

Additionally, users often need to sanitize objects that they possess that have been operated or otherwise handled while the user is in the public and touching other publicly accessible surfaces. For example, a user may need to wipe down their phone after touching a public door handle and then operating their phone. Typically, a sanitizer wipe and/or napkin may be used to clean the surface of the phone or other objects.

Furthermore, in situations such as the prevalence of a pandemic or other outbreak of disease, users may be tempted to steal or otherwise remove a bottle of sanitizer solution provided by a business or other entity. A need exists for a sanitizer distribution stand or other sanitizing or fluid dispenser that has a lockable and/or securable cap or lid.

Some proposed solutions have attempted to overcome the issue of commonly used dispenser pumps, such as battery-operated electronic sensors for dispensing a desired quantity of sanitizer solution to a user. Other solutions provide a wipe container that may be used to draw napkins, wipes, and/or other contents from within the container. However, no known device combines the ability to operate a sanitizer stand in a handless fashion while also being able to access sanitizing wipes. Additionally, no known devices combine the ability to dispense sanitizer solutions using a hands-free operation via a sanitizer dispensing tower having an attachable sign interface, locking cap, and other features to solve the deficiencies in the prior art.

Therefore, a need exists to solve the deficiencies present in the prior art. What is needed is an apparatus capable of dispensing a fluid without requiring use of the hands. What is needed is an apparatus to provide actuation of a replaceable bottle via engagement of a foot pedal. What is needed is an apparatus to dispense sanitization wipes and sanitizer fluid to users. What is needed is a lockable fluid dispensing apparatus capable of receiving replaceable bottles.

SUMMARY

An aspect of the disclosure advantageously provides an apparatus capable of dispensing a fluid without requiring use of the hands. An aspect of the disclosure advantageously provides an apparatus to provide actuation of a replaceable bottle via engagement of a foot pedal. An aspect of the disclosure advantageously provides an apparatus to dispense sanitization wipes and sanitizer fluid to users. An aspect of the disclosure advantageously provides a lockable fluid dispensing apparatus capable of receiving replaceable bottles.

Accordingly, the disclosure may feature a fluid dispensing apparatus including a body, footing, and internal components. The body may extend from a body dispensing end to a body pedal end. A body window may be located near the body dispensing end of the body through which at least part of a dispensing object is accessible. The footing may be attached to the body at the body pedal end. A pedal may be operatively installed to the body at the body pedal end via a fulcrum member. A platform may be located within the body to receive the dispensing object. An actuation rod may be located within the body and extending from the pedal to the platform. Movement of the actuation rod via operation of the pedal may result in movement of the platform. A container may be positioned in proximity to the dispensing object such that movement of the platform operates the dispensing object.

In another aspect, the footing may be at least partially welded to the body.

In another aspect, a spring may be located between a pedal spring interface of the pedal and a footing spring interface of the footing. The pedal may be manipulable between a pedal disengaged position and a pedal engaged position. The pedal may be moved at least partially to the pedal engaged position via a pedal force applied to the pedal that is greater than a spring force. The pedal may return to the pedal disengaged position when the pedal force is less than the spring force.

In another aspect, the pedal may include a pedal fulcrum member receiving interface. The pedal may pivot about the fulcrum member operatively installed to the body via the pedal fulcrum member receiving interface.

In another aspect, the dispensing object may be a bottle removably installable to the platform.

In another aspect, a tray may be installed to the body window.

In another aspect, a container lid may be provided including a container lid dispensing interface through which container contents held by the container are selectively taken from the container.

In another aspect, the container lid may include a container lid locking pin. The body may include a body locking pin receiver located near the body dispensing end to selectively receive the container lid locking pin. Upon the container locking pin being located in the body locking pin receiver, the container lid may be at least partially rotatable to reversibly lock the container lid to the body.

In another aspect, the container lid may include a container lid locking clip. The body may include a body locking clip receiver located near the body dispensing end to selectively receive the container lid locking clip. The container may be reversibly attachable to the body via the container lid locking clip.

In another aspect, a sign member may be reversibly installed to the container lid.

In another aspect, a bolt may be passed through a sign member bolt aperture provided by the sign member and a container lid bolt aperture provided by the container lid to selectively attach the sign member to the container lid.

In another aspect, the bolt may include a bolt aperture configured to receive a lock.

In another aspect, a sign member may be reversibly installed to the body.

In another aspect, the footing may include a footing installation aperture.

In another aspect, the platform may include a platform bottom bracing member installed to a platform actuation rod receiving member to increase durability.

According to an embodiment enabled by this disclosure, a body may be provided extending from a body dispensing end to a body pedal end. A body window may be located near the body dispensing end of the body through which at least part of a dispensing object is accessible. Footing may be attached to the body at the body pedal end. A pedal may be operatively installed to the body at the body pedal end via a fulcrum member. A platform may be located within the body to receive the dispensing object. An actuation rod may be located within the body and extending from the pedal to the platform, wherein movement of the actuation rod via operation of the pedal may result in movement of the platform. A spring may be located between the pedal and the footing. The pedal may be manipulable between a pedal disengaged position and a pedal engaged position. The pedal may be moved at least partially to the pedal engaged position via a pedal force applied to the pedal that is greater than a spring force. The pedal may return to the pedal disengaged position when the pedal force is less than the spring force. The pedal may include a pedal fulcrum member receiving interface. The pedal may pivot about the fulcrum member operatively installed to the body via the pedal fulcrum member receiving interface. The platform may include a platform bottom bracing member installed to a platform actuation rod receiving member of the platform to increase durability.

In another aspect, a container may be positioned in proximity to the dispensing object such that movement of the platform operates the dispensing object via compression.

In another aspect, a container lid may include a container lid dispensing interface through which container contents held by the container are selectively taken from the container.

According to an embodiment enabled by this disclosure, a method for dispensing a fluid via a fluid dispensing apparatus comprising a body extending from a body dispensing end to a body pedal end and a pedal operatively installed to the body at the body pedal end. The method may include (a) at least partially pivoting the pedal about a fulcrum member. The method may include (b) moving an actuation rod located within the body and extending from the pedal to a platform via operation of the pedal. The method may include (c) moving the platform located within the body, the platform being configured to receive a dispensing object to be moved with the platform. The method may include (d) actuating at least part of the dispensing object to dispense a fluid through a body window located near the body dispensing end of the body through which at least part of the dispensing object is accessible. Footing may be attached to the body at the body pedal ends.

In another aspect, the dispensing object may be removably installable to the platform. The container lid may include a container lid locking pin. The body may include a body locking pin receiver located near the body dispensing end to selectively receive the container lid locking pin. The method may further include (e) at least partially rotating the container locking pin located in the body locking pin receiver to reversibly lock the container lid to the body.

Terms and expressions used throughout this disclosure are to be interpreted broadly. Terms are intended to be understood respective to the definitions provided by this specification. Technical dictionaries and common meanings understood within the applicable art are intended to supplement these definitions. In instances where no suitable definition can be determined from the specification or technical dictionaries, such terms should be understood according to their plain and common meaning. However, any definitions provided by the specification will govern above all other sources.

Various objects, features, aspects, and advantages described by this disclosure will become more apparent from the following detailed description, along with the accompanying drawings in which like numerals represent like components.

DETAILED DESCRIPTION

Figure 1:
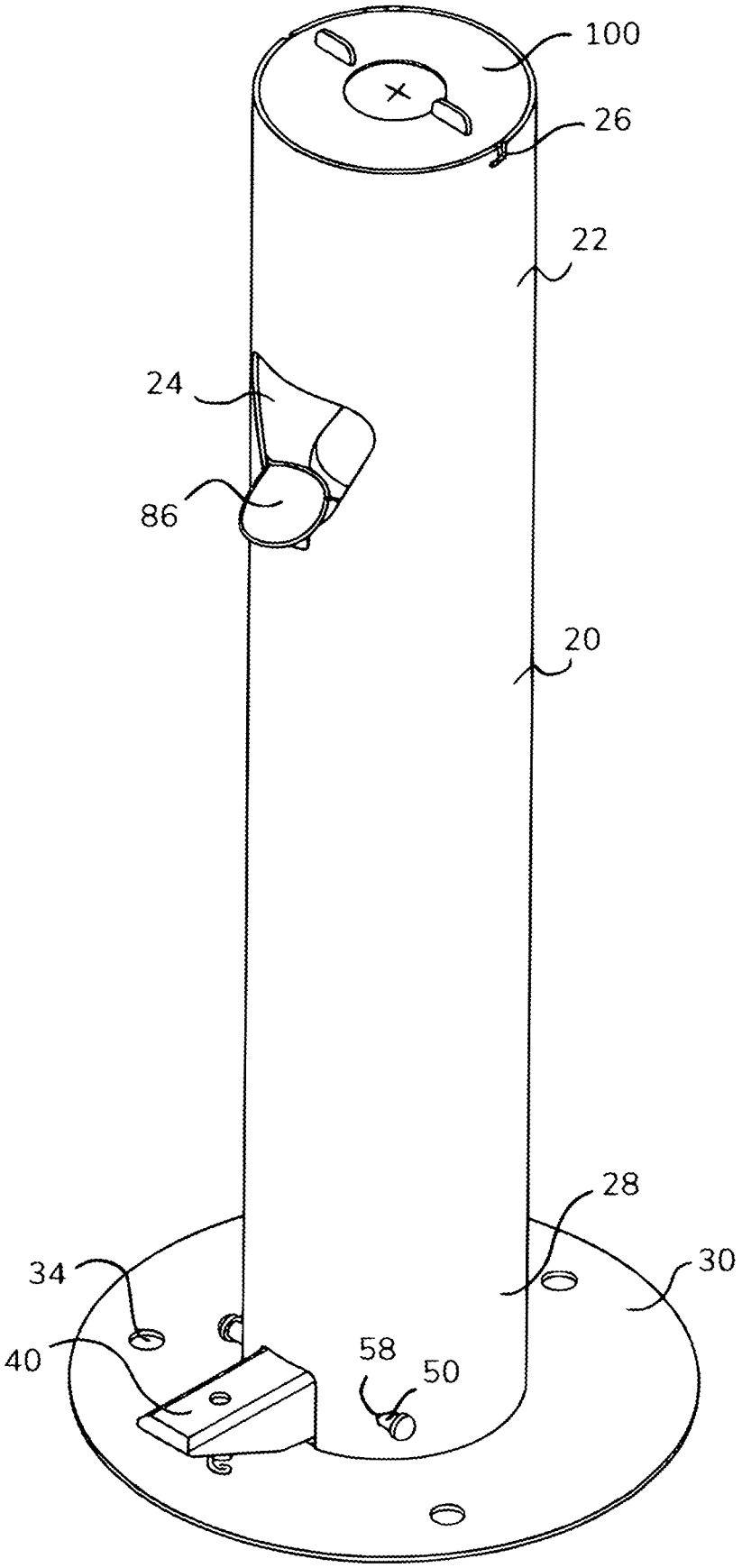
FIG. 1 is a perspective view of exterior aspects of an illustrative fluid dispensing apparatus, according to an embodiment of this disclosure.
Figure 2:
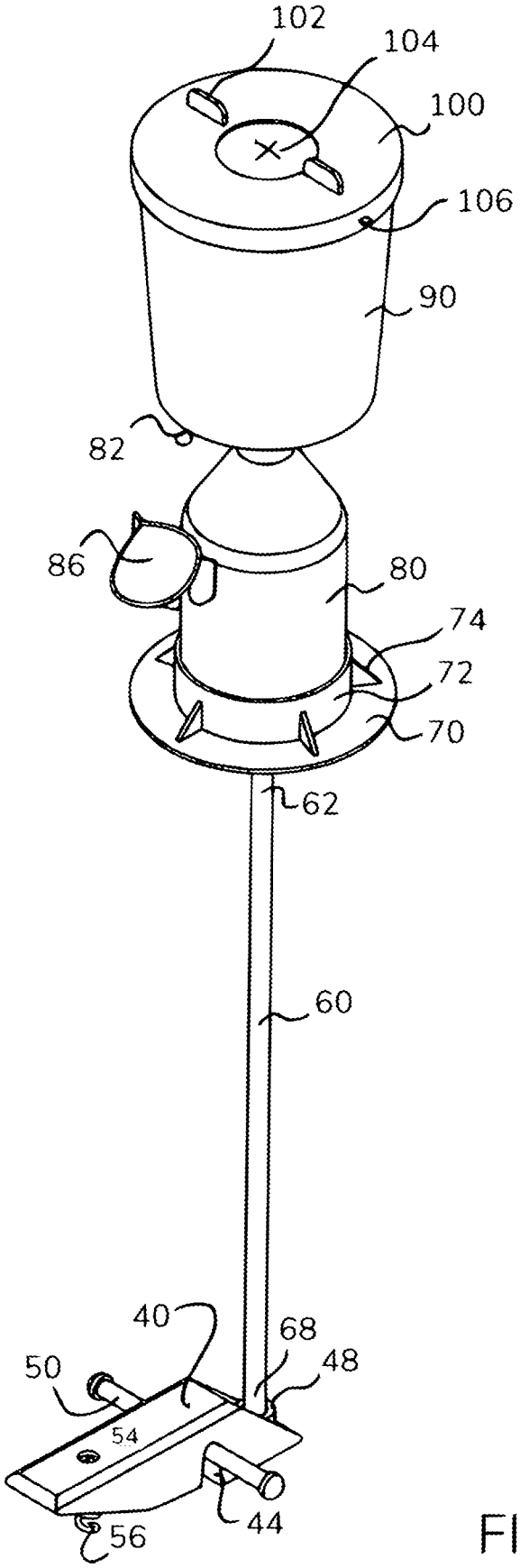
FIG. 2 is a perspective view of interior aspects of an illustrative fluid dispensing apparatus, according to an embodiment of this disclosure.

The following disclosure is provided to describe various embodiments of a fluid dispensing apparatus. Skilled artisans will appreciate additional embodiments and uses of the present invention that extend beyond the examples of this disclosure. Terms included by any claim are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

For the purpose of clearly describing the components and features discussed throughout this disclosure, some frequently used terms will now be defined, without limitation. The term fluid, as it is used throughout this disclosure, is defined as a substance having particles that easily move and change their relative position without a separation of mass, such as by flowing. The term dispensing object, as it is used throughout this disclosure, is defined as an object capable of holding and dispensing a fluid, for example, a bottle or other similar object. The term container, as it is used throughout this disclosure, is defined as an object capable of removably holding contents, for example, a container for sanitization wipes or napkins. The term fulcrum member, as it is used throughout this disclosure, is defined as a component about which an object may pivot.

Various aspects of the present disclosure will now be described in detail, without limitation. In the following disclosure, a fluid dispensing apparatus will be discussed. Those of skill in the art will appreciate alternative labeling of the fluid dispensing apparatus as a sanitizer dispenser, sani-spire, fluid dispensing tower, the invention, or other similar names. Similarly, those of skill in the art will appreciate alternative labeling of the fluid dispensing apparatus as a hands free fluid dispensing operation, sanitization facilitation method, fluid dispensing operation, method, operation, the invention, or other similar names. Skilled readers should not view the inclusion of any alternative labels as limiting in any way.

Referring now to FIGS. 1-5, illustrative examples of a fluid dispensing apparatus enabled by this disclosure will now be discussed in more detail. The fluid dispensing apparatus may include a body, footing, pedal, actuation rod, platform, dispensing object, container, container lid, sign member, bolt, and additional components that will be discussed in greater detail below. The fluid dispensing apparatus may operate one or more of these components interactively with other components for dispensing fluids and objects without requiring use of hands.

Figure 3:
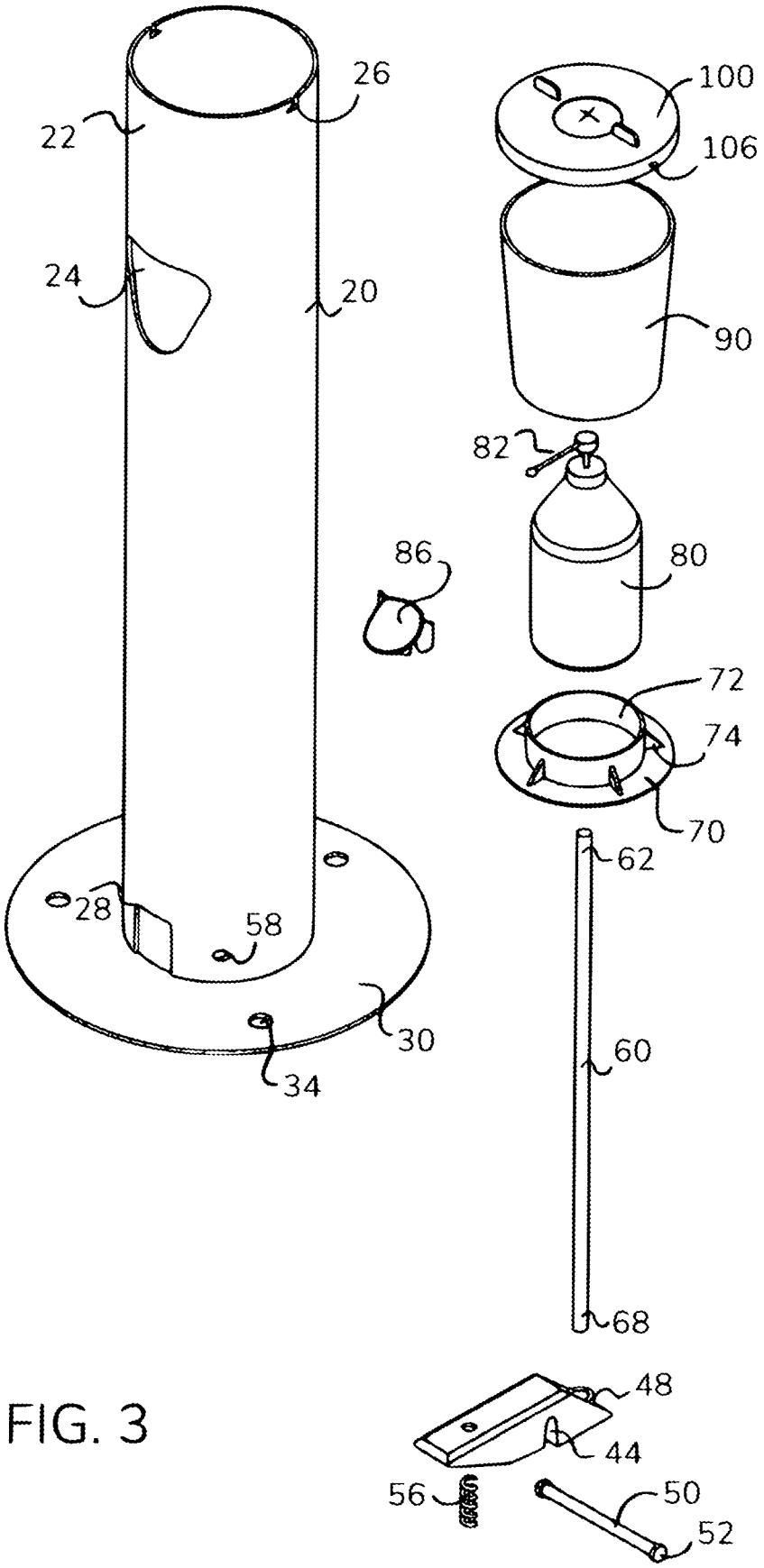
FIG. 3 is an exploded view of aspects of an illustrative fluid dispensing apparatus, according to an embodiment of this disclosure.
Figure 4:
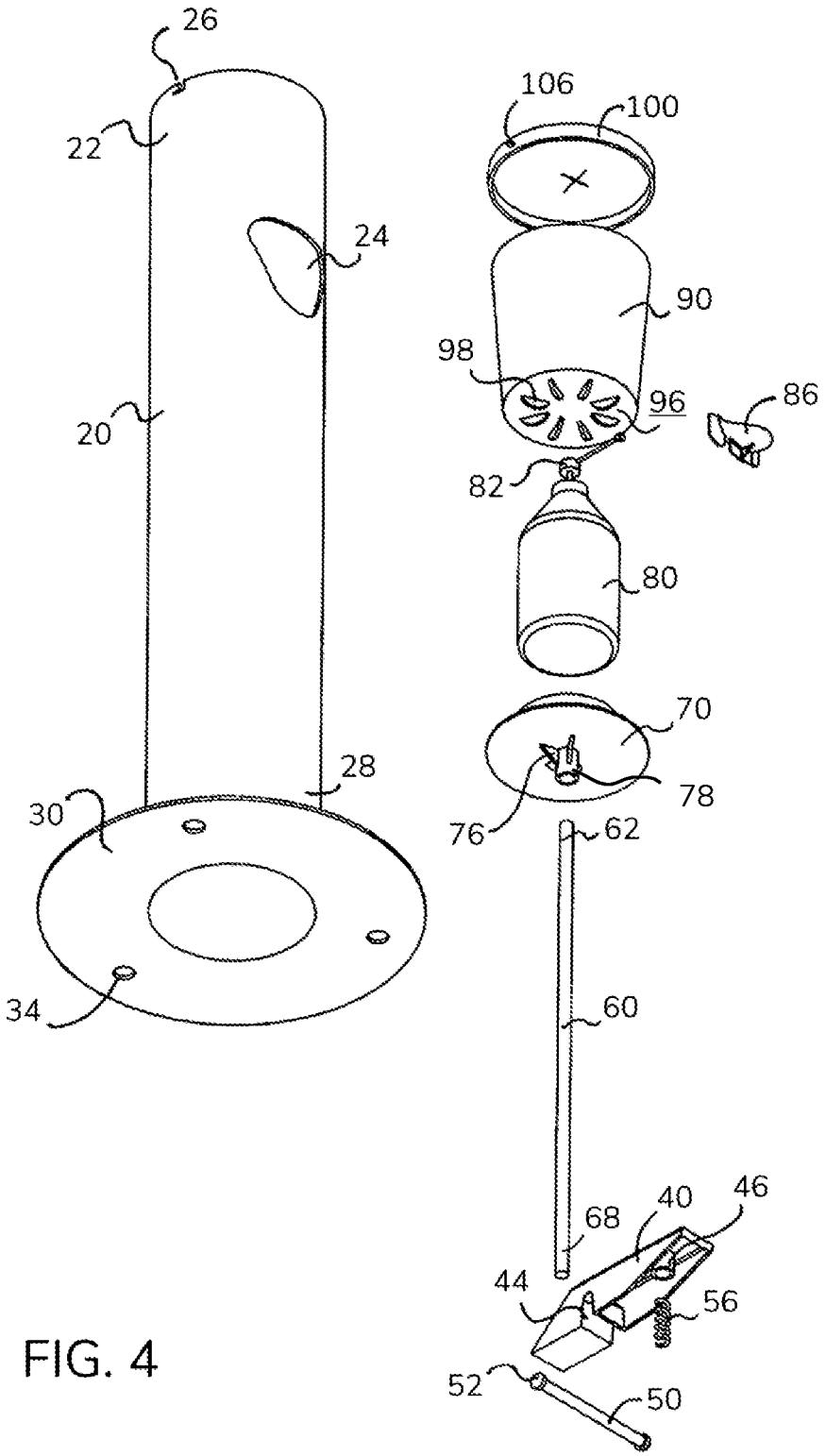
FIG. 4 is an exploded view of aspects of an illustrative fluid dispensing apparatus, according to an embodiment of this disclosure.

The body will now be discussed in greater detail. FIGS. 1 and 3-4 highlight examples of the body, which may also be shown in other figures. Generally, the body 20 may include material extending from a body dispensing end 22 to a body pedal end 28. The body 20 may include a body window 24 located near the body dispensing end 22 of the body 20 through which at least part of a dispensing object 80 is accessible, for example, a dispensing object pump spout 82 that may extend at least partially through the body window 24. A tray 86 may also be installed to the body 20, for example, at the body window 24.

The body 20 may be provided by an elongated member extending over a desired length or height. For example, the body 20 may be provided by a cylindrical member extending from a body dispensing end 22 to a body pedal end 28. An interior portion of the body 20 may be substantially open and/or hollow, allowing components to be included within the interior space provided by the body. The components may be inserted into the interior space of the body 20 via an opening at the top of the body 20 near the body dispensing end 22, or elsewise as will be apparent after having the benefit of this disclosure.

The body 20 may be constructed using various materials such as plastics, metals, aluminum, steel, synthetics, and/or other materials that would be apparent to a person of skill in the art after having the benefit of this disclosure. In some embodiments, the body 20 may be constructed using multiple materials, such as by using a rigid metallic material to construct the cylindrical portion of the body 20 and additional materials to facilitate operation of an apparatus including the body 20 without the user having to contact hard materials. In some embodiments, at least part of the body 20 may be painted to improve aesthetic and/or anti-corrosion properties. For example, a body 20 provided as a metallic structure may be painted with a powder coating to improve corrosion resistance and aesthetic appearance.

In one optional embodiment, lettering may be provided on the body 20. For example, lettering may be printed on a surface of the body 20. In another example, the body 20 may be painted, and lettering may be applied to the painted surface of the body 20. In another embodiment, lettering may be etched and/or removed from the material used to construct the body 20. In this embodiment, at least part of the interior space of the body 20 may be viewable through the etched and/or removed material. Skilled artisans will appreciate that graphics, imagery, and other features may be provided by and/or applied to the body 20 without limitation.

The body 20 may include a body window 24 through which at least part of a dispensing object 80 may be accessible. For example, the body 20 may include a body window 24 near the body dispensing end 22, which may be oriented towards the top portion of the body 20, without limitation.

In one example, the dispensing object 80 may be a sanitizer bottle and may include a dispensing object pump spout 82, for example a pump spout provided by the sanitizer bottle. At least part of the dispensing object pump spout 82 may extend outwardly through the body window 24 and/or be accessible within the body 20 via the body window 24. Upon operation of an apparatus enabled by this disclosure, the dispensing object 80 may be operated to deliver a fluid, such as a sanitizer fluid, to a user through the dispensing object pump spout 82 that at least partially extends through the body window 24.

In one embodiment, the orientation of the dispensing object 80 may be such that upon operation of the apparatus enabled by this disclosure, the relative position of the dispensing object pump spout 82 remains approximately static during operation. This orientation may advantageously provide expectable results for a user to receive the fluid dispensed by the dispensing object 80. Optionally, an additional portion of material may be removed from the body 20 such that a user or other person may observe a level of fluid held by the dispensing object 80 located within the body 20.

The body 20 may additionally include body locking pin receivers 26, which may correspond with container lid locking pins 106 provided by a container lid 100. The body locking pin receivers 26 may be constructed such to receive the corresponding container lid locking pins 106 by lowering the container lid 10 through a vertical portion of the body locking pin receiver 26 until reaching a bottom edge of the body locking pin receiver 26. The container lid 100 may then be at least partially rotated to move the container lid locking pins 106 in an approximately horizontal direction. Upon being rotated, the container lid locking pins 106 may be at least partially restricted from being lifted out of the body locking pin receiver 26. The container lid 100 may additionally be removably installed to the body 20 via a lock, a container lid locking clip that may correspond with a body clip receiver, and/or otherwise as will be appreciated by a person of skill in the art after having the benefit of this disclosure.

The footing will now be discussed in greater detail. FIGS. 1 and 3-4 highlight examples of the footing, which may also be shown in other figures. Generally, the footing 30 may be attached to the body 20 at the body pedal end 28. In some embodiments, the footing 30 may be at least partially welded to the body 20. The footing 30 may additionally include a footing installation aperture 34.

The footing 30 may be provided by a portion of material operatively attached to the body 20 near the body pedal end 28. The footing 30 may be constructed using a material similar to that which is used to construct the body 20. Alternatively, the footing 30 may be constructed using a different material than used to construct the body 20. In one example, the body 20 and the footing 30 may be constructed using a metallic material such as steel or aluminum.

The footing 30 may be operatively attached to the body 20. For example, the footing 30 may be installed to the body 20 using screws, clips, brackets, and other attachment hardware that will be appreciated by a person of skill in the art after having the benefit of this disclosure. In another embodiment, at least part of the footing 30 may be welded to the body 20 near the body pedal end 28. In this embodiment, the welding may improve the strength of the connection between the footing 30 and the body 20 such to prevent breaking and/or deformation during operation. Those having skill in the art will appreciate that welding may be applied to metal substances, plastic substances, synthetic substances, and/or virtually any other substance that may be attachable via welding, without limitation.

The footing 30 may include one or more footing apertures 34. If included the footing apertures 34 may facilitate installation of an apparatus enabled by this disclosure to an installation location. For example, a screw or bolt may be passed through a footing aperture 34 provided by the footing 30, through which an apparatus enabled by this disclosure may be installed to a ground or floor surface. In some embodiments, locking nuts may be used to prevent or deter theft of an apparatus enabled by this disclosure from an installation location.

The pedal will now be discussed in greater detail. FIGS. 1-4 highlight examples of the pedal, which may also be shown in other figures. Generally, a pedal 40 may be operatively installed to the body 20 at the body pedal end 28 via a fulcrum member 50. A spring 56 may be located between a pedal spring interface 46 of the pedal 40 and a footing spring interface of the footing 30. The pedal 40 may be manipulable between a pedal disengaged position and a pedal engaged position, where the pedal 40 can be moved at least partially to the pedal engaged position via a pedal force applied to the pedal that is greater than a spring force applied by the spring 56. The pedal may return to the pedal disengaged position when the pedal force is less than the spring force.

The pedal 40 may be provided to operate components located within the body 20, which may be used to dispense a fluid such as a sanitizer fluid during operation. The pedal 40 may be operatively installed to the body 20 via a fulcrum member 50. The pedal 40 may include a pedal fulcrum receiving interface 44 that may engage with the fulcrum member 50. In one embodiment, the pedal fulcrum receiving interface 44 may be pivotable about the fulcrum member 50. In one example, the pedal fulcrum receiving interface 44 may be an at least partially opened channel of removed material configured to be placed over a fulcrum member 50 such that it may provide pivoting action of the pedal 40 when operated.

The pedal 40 may be inserted into a portion of removed material from the body 20 near the body pedal end 28. The pedal 40 may be positioned such that the pedal fulcrum receiving interface 44 aligns with fulcrum member receiving apertures 58 located on the body 20 near the body pedal end 28. The fulcrum member 50 may be at least partially inserted into one of a set of fulcrum member receiving apertures 58 provided by the body 20, passing through at least part of the pedal fulcrum receiving interface 44, and exiting another fulcrum member receiving aperture 58 provided by the body 20. Fulcrum member caps 52 may be installed to one or more of the ends of the fulcrum member 50 such to reduce the likelihood of the fulcrum member 50 becoming dislodged and/or removed from its installed position in the body 20 during operation or otherwise.

The pedal 40 may include a pedal top surface 54, which may be engaged by the foot or other extension of a user during operation. Those having skill in the art will appreciate that virtually any object may operate the pedal 40, such as via engagement with the pedal top surface 54.

The pedal 40 may additionally include a pedal spring interface 46 located on a bottom portion of the pedal 40, which may receive a spring 56 located between the pedal 40 and the footing 30. The footing 30 may include a footing spring receiving interface to correspond with the pedal spring receiving interface 46 such that the spring 56 may be installed between the pedal 40 and the footing 30 substantially securely and having a low risk of becoming dislodged during operation.

Distal to the end of the pedal 40 at which the spring 56 may be installed, such as at the other end of the fulcrum member 50, a pedal actuation rod interface 48 may be provided to receive and/or interact with an actuation rod 60. For example, an actuation rod 60 may be at least partially inserted into the pedal actuation rod interface 48 such that movement of the pedal 40 may be translated to movement of the actuation rod 60.

The pedal 40 may be manipulated between a pedal engage state and a pedal disengage state. For example, in the pedal disengage state, an apparatus enabled by this disclosure may be in an idle status such that no fluid is being actively dispensed from the dispensing object 80. Additionally, for example, in the pedal engaged state, an apparatus enabled by this disclosure may be in a dispensing state such that fluid is pumped out of or otherwise delivered from the dispensing object 80.

The spring 56 may apply a spring force to an underside of the pedal 40. This spring force may be approximately persistent and may be configured based on the choice of spring 56 installed between the pedal 40 and the footing 30. While minimal or no force is being applied to the pedal top surface 54 of the pedal 40, the spring force may maintain the pedal 40 in the pedal disengaged state. If it is desired to operate an apparatus enabled by this disclosure, a user may apply a force to the pedal 40, for example via the pedal top surface 54. This engagement may be applied as a pedal force. When the pedal force is greater than the spring force, the pedal 40 may be at least partially depressed, which may lift the pedal actuation rod interface 48 on the opposite end of the fulcrum member 50 to move an operatively connected dispensing object 80. Conversely, when the pedal force is less than the spring force, the pedal 40 may resist movement and thus not engage the operatively connected dispensing object 80.

The actuation rod will now be discussed in greater detail. FIGS. 1-4 highlight examples of the actuation rod, which may also be shown in other figures. Generally, an actuation rod 60 may be located within the body 20 and extending from the pedal 40 to the platform 70, wherein movement of the actuation rod 60 via operation of the pedal 40 results in movement of the platform 70.

The actuation rod 60 may be provided to translate force or movement from the pedal 40 to a platform 70. The actuation rod 60 may include in elongated length of material extending from an actuation rod pedal end 68 to the actuation rod platform end 62. The actuation rod 60 may be received at its actuation rod pedal end 68 by a pedal actuation rod interface 48 of the pedal 40. Additionally, the actuation rod 60 may be received at its actuation rod platform end 62 by a platform actuation rod receiving interface 78 of the platform 70.

Upon operation, force or movement may be communicated from an end of the actuation rod 60 receiving the force to a distal end of the actuation rod 60 to apply at least part of the received force. For example, movement of the pedal 40 may apply a force to the actuation rod 60 at the actuation rod pedal end 68. This force may be translated through the length of the actuation rod 60 to the actuation rod platform end 62, supplying such force to the platform 70 connected to the actuation rod 60.

The actuation rod 60 may be constructed using a variety of materials, such as, plastics, metals, synthetics, fibers, and/or other materials that would be apparent to a person of skill in the art. The actuation rod 60 may be replaceable, advantageously allowing repairability of an apparatus enabled by this disclosure. The actuation rod 60 may additionally be provided in varying lengths, which may allow customization of an apparatus enabled by this disclosure to accommodate bottles and/or other dispensing objects 80 of various sizes and configurations.

The platform will now be discussed in greater detail. FIGS. 1-4 highlight examples of the platform, which may also be shown in other figures. Generally, the platform 70 may be located within the body 20 to receive the dispensing object 80.

The platform 70 may be provided to hold and/or secure a dispensing object 80 that may be operated to dispense a fluid to a user. For example, the platform 70 may hold a bottle of sanitizer solution. The platform 70 may include a platform dispensing object receiving interface 72 to receive and/or secure a dispensing object 80 such as a sanitizer dispensing bottle, without limitation.

In one example, the platform dispensing object receiving interface 72 may be provided having a receiving shape that corresponds with a bottle or other dispensing object 80 that may be inserted within the space provided by the platform dispensing object receiving interface 72. In one embodiment, various platforms 70 may be interchangeable that may relate or correspond with various sizes and shapes of dispensing objects 80. The platform 70 may include platform top bracing members 74 to increase the rigidity and durability of the platform dispensing object receiving interface 72, and thus improve the function of securely holding the dispensing object 80 during operation and otherwise.

The platform 70 may additionally include a platform actuation rod receiving interface 78 to receive an actuation rod 60. For example, the platform actuation rod receiving interface 78 may receive an actuation rod 60 at its actuation rod platform end 62. In this example, the actuation rod 60 may be at least partially inserted into a space provided by the platform actuation rod receiving interface 78. Platform bottom bracing members 76 may be provided to increase the strength and durability of the platform actuation rod receiving interface 78 and thus connection with the actuation rod 60 to the platform 70.

The dispensing object will now be discussed in greater detail. FIGS. 1-4 highlight examples of the dispensing object, which may also be shown in other figures. Generally, the dispensing object 80 may be provided by a bottle removably installable to the platform. However, those of skill in the art will appreciate additional configurations of a dispensing object 80 that may be used with various embodiments of an apparatus enabled by this disclosure that are consistent and included within the scope and spirit of this disclosure.

A dispensing object 80 may be provided to deliver a fluid or other material to a user during operation. In one example, the dispensing object 80 may be a bottle holding sanitizer solution, without limitation. The dispensing object 80 may include a dispensing object pump spout 82 or other fluid delivery mechanism and that may be operated to draw contents from within the dispensing object 80 to an external space. For example, the dispensing object pump spout 82 may include a pump top surface that may interact with another object such that upon depressing the dispensing object pump spout 82, fluid is pumped out of the interior space of the dispensing object 80 and, as an example, into the hands of a user.

The dispensing object 80 may be provided as a customized size compatible with an apparatus enabled by this disclosure. Alternatively, the dispensing object 80 may be a commercially available bottle purchased separately from the apparatus enabled by this disclosure. As discussed above, various platforms 70 may be interchangeably provided such that may correspond with bottles and/or other dispensing objects 80 having various sizes, shapes, and other configurations.

A tray 86 may be provided to catch excess fluid drawn from the dispensing object 80. The tray 86 may be operatively installed to a portion of the body 20, for example in the body window 24. The tray 86 may be removable from the body 20 to provide for easy cleaning, replacement, and other maintenance activities that will be appreciated by a person of skill in the art after having the benefit of this disclosure. The tray 86 may be constructed using various materials such as plastics, rubbers, synthetics, metal, and other materials that will be appreciated by skilled artisans.

The container will now be discussed in greater detail. FIGS. 1-4 highlight examples of the container, which may also be shown in other figures. Generally, the container 90 may be positioned in proximity to the dispensing object 80 such that movement of the platform 70 operates the dispensing object 80.

In one illustrative embodiment, a container 90 may be provided to store and/or distribute its container contents to a user. For example, the container 90 may include sanitizer wipes, napkins, facial tissues, clean tissues, and/or other container contents that would be appreciated by those of skill in the art after having the benefit of this disclosure. The container 90 may be configured as a tub like structure, providing an interior space in which container contents may be provided. The container 90 may include a substantially solid container bottom surface 96, which may optionally be strengthened via installation or provision of container braces 98.

The container bottom surface of the container 90 may be oriented such that it may interact with at least part of the dispensing object 80. For example, the container bottom surface may interact with a dispensing object pump spout 82 during operation. In this example, engagement of the pedal 40 may translate force and movement through the actuation rod 60 such to increase the elevation of a connected platform 70. As the platform 70 rises, so will the dispensing object 80 held by the platform such that the distance between the platform 70 and the container 90 is reduced. This reduction of distance may at least partially depress the dispensing object pump spout 82 such to draw fluid from the interior space of the dispensing object 80 during operation. Additionally, as pedal force is removed from the pedal 40, the actuation rod 60, platform 70, and dispensing object 80 may return to and idle position provided by a disengaged state. This action may re-establish the idle distance between the platform 70 and the container bottom surface 96 of the container 90. Therefore, the dispensing object pump spout 82 may no longer be depressed and may return to its non-operational state.

The container lid will now be discussed in greater detail. FIGS. 1-5 highlight examples of the container lid, which may also be shown in other figures. Generally, the container lid 100 may include a container lid dispensing interface 104 through which container contents held by the container 90 are selectively taken from the container 90.

In one embodiment, the container lid 100 may be provided such that may be fitted to a top portion of the container 90 and hold the container contents of the container 90 securely inside. The container lid 100 may be approximately airtight, such as to prevent and/or reduce the rate at which the container contents held by the container 90 may lose moisture or dry out.

The container lid 100 may include container lid tabs 102, which may facilitate installation of the container lid 100 to the container 90 and/or the body 20. The container lid 100 may additionally include a container lid dispensing interface 104 through which the container contents held by the container 90 may be drawn through the container lid 100 without having to remove the container lid 100 from the container 90 to do so.

The container lid 100 may additionally include one or more container lid locking pins 106. If included, the container lid locking pins 106 may correspond with one or more body locking pin receivers 26 located on the body 20 near the body dispensing end 22 to selectively receive the container lid locking pin 106. The container locking pin 106 that is located in the body locking pin receiver 26 is at least partially rotatable to reversibly lock the container lid 100 to the body 20.

In another embodiment, the container lid 100 may include a container lid locking clip which may correspond with a body locking clip receiver provided by the body 20 to additionally and/or alternatively secure the container lid 100, and thus container 90, within the body 20. In this embodiment, the container 90 may be reversibly attachable to the body 20 via the container lid locking clip.

Figure 5:
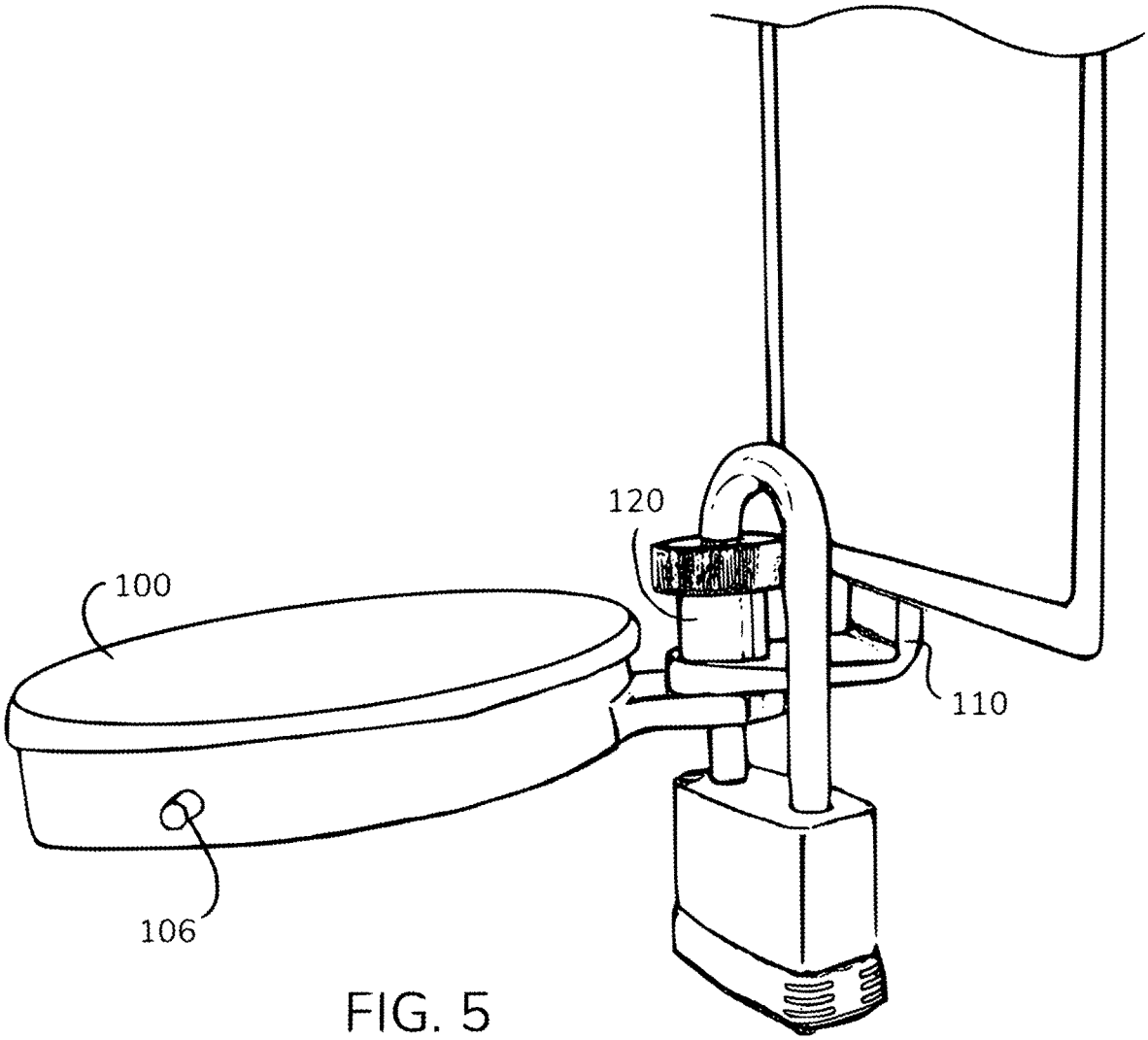
FIG. 5 is a perspective view of aspects of an illustrative fluid dispensing apparatus having a sign member attached, according to an embodiment of this disclosure.

The sign member will now be discussed in greater detail. FIG. 5 highlights examples of the sign member, aspects of which may also be shown in other figures. Generally, the sign member 110 may be reversibly installed to the container lid 100. In an alternative configuration, the sign member 110 may be reversibly installed to the body 20. Those of skill in the art will appreciate additional installation configurations to be included in the scope and spirit of this disclosure after having the benefit of this disclosure.

In one alternative embodiment, a sign member 110 may be provided to display information to a user via a sign installable to the sign member 110. The sign member may include a frame about which a sign may be held, a sign member interior space into which the sign may be inserted, and a sign member arm that may operatively interact with a corresponding receiver of the body 20 and/or container lid 100. The sign member 110 may include a sign member aperture through which the sign member 110 may be installed to the body 20, container lid 100, and/or other aspect of an apparatus enabled by this disclosure, for example, via a bolt 120.

The bolt will now be discussed in greater detail. FIG. 5 highlights examples of the bolt, which may also be shown in other figures. Generally, a bolt 120 may be passed through a sign member bolt aperture provided by the sign member 110 and a container lid bolt aperture provided by the container lid 100 and/or body 20 to selectively attach the sign member 110 to the container lid 100 and/or body 20. The bolt 120 may include a bolt aperture configured to receive a lock.

In one illustrative embodiment, the sign member aperture may correspond with a bolt 120 that may be passed through the sign member aperture and a portion of the body 20 and/or container lid 100 to removably and operatively secure the sign member 110 to the body 20.

In one embodiment, the sign member aperture and an aperture provided by the extended portion from the body 20 and/or container lid 100 may have varying diameters that may correspond with diameters provided by the bolt 120. The bolt 120 may additionally include a bolt aperture through which an object may be passed. For example, and without limitation, a lock may be passed through the bolt aperture to operatively secure the sign member 110 to the body 20 of an apparatus enabled by this disclosure.

In operation, a method may be provided for dispensing fluids and objects without requiring use of hands. Those of skill in the art will appreciate that the following methods are provided to illustrate an embodiment of the disclosure and should not be viewed as limiting the disclosure to only those methods or aspects. Skilled artisans will appreciate additional methods within the scope and spirit of the disclosure for performing the operations provided by the examples below after having the benefit of this disclosure. Such additional methods are intended to be included by this disclosure.

In an illustrative operation, provided without limitation, a method of dispensing a fluid via a fluid dispensing apparatus that includes a body extending from a body dispensing end to a body pedal end and a pedal operatively installed to the body at the body pedal end may be provided. The operation may begin with at least partially pivoting the pedal about a fulcrum member. This step may be performed, for example, by stepping on the pedal with the foot of a user. The operation may additionally include moving an actuation rod located within the body and extending from the pedal to a platform via operation of the pedal. The operation may further include moving the platform located within the body. As discussed above, the platform may be configured to receive a dispensing object to be moved with the platform. The operation may include actuating at least part of the dispensing object to dispense a fluid through a body window located near the body dispensing end of the body through which at least part of the dispensing object is accessible.

In some embodiments of this illustrative operation, a footing may be attached to the body at the body pedal ends. Additionally, the dispensing object may be removably installable to the platform. The container lid may include a container lid locking pin and the body may include a body locking pin receiver to selectively receive the container lid locking pin. In these embodiments, the method may further include at least partially rotating the container locking pin located in the body locking pin receiver to reversibly lock the container lid to the body.

While various aspects have been described in the above disclosure, the description of this disclosure is intended to illustrate and not limit the scope of the invention. The invention is defined by the scope of the appended claims and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the following claims.

What is claimed is:

1. A fluid dispensing apparatus comprising:

a body extending from a body dispensing end to a body pedal end;

a body window located near the body dispensing end of the body through which at least part of a dispensing object is accessible;

a footing attached to the body at the body pedal end;

a pedal operatively installed to the body at the body pedal end via a fulcrum member;

a platform located within the body to receive the dispensing object;

an actuation rod located within the body and extending from the pedal to the platform, wherein movement of the actuation rod via operation of the pedal results in movement of the platform;

wherein the platform comprises a platform bottom bracing member installed to a platform actuation rod receiving interface to increase durability; and a container positioned in proximity to the dispensing object such that movement of the platform operates the dispensing object.

2. The fluid dispensing apparatus of claim 1, wherein the footing is at least partially welded to the body.

3. The fluid dispensing apparatus of claim 1, further comprising:

a spring located between a pedal spring interface of the pedal and the footing;

wherein the pedal is manipulable between a pedal disengaged position and a pedal engaged position;

wherein the pedal is moved at least partially to the pedal engaged position via a pedal force applied to the pedal that is greater than a spring force;

wherein the pedal returns to the pedal disengaged position when the pedal force is less than the spring force.

4. The fluid dispensing apparatus of claim 1:

wherein the pedal comprises a pedal fulcrum member receiving interface; and wherein the pedal pivots about the fulcrum member operatively installed to the body via the pedal fulcrum member receiving interface.

5. The fluid dispensing apparatus of claim 1, wherein the dispensing object is a bottle removably installable to the platform.

6. The fluid dispensing apparatus of claim 1, further comprising a tray installed to the body window.

7. The fluid dispensing apparatus of claim 1, further comprising a container lid comprising a container lid dispensing interface through which container contents held by the container are selectively taken from the container.

8. The fluid dispensing apparatus of claim 7, wherein the container lid comprises a container lid locking pin;

wherein the body comprises a body locking pin receiver located near the body dispensing end to selectively receive the container lid locking pin;

wherein the container locking pin that is located in the body locking pin receiver is at least partially rotatable to reversibly lock the container lid to the body.

9. The fluid dispensing apparatus of claim 7, wherein the container lid comprises a container lid locking clip;

wherein the body comprises a body locking clip receiver located near the body dispensing end to selectively receive the container lid locking clip;

wherein the container is reversibly attachable to the body via the container lid locking clip.

10. The fluid dispensing apparatus of claim 7, further comprising:

a sign member reversibly installed to the container lid.

11. The fluid dispensing apparatus of claim 10, further comprising:

a bolt passed through a sign member bolt aperture provided by the sign member and a container lid bolt aperture provided by the container lid to selectively attach the sign member to the container lid.

12. The fluid dispensing apparatus of claim 11, wherein the bolt comprises a bolt aperture configured to receive a lock.

13. The fluid dispensing apparatus of claim 1, further comprising:

a sign member reversibly installed to the body.

14. The fluid dispensing apparatus of claim 1, wherein the footing comprises a footing installation aperture.

15. A fluid dispensing apparatus comprising:

a body extending from a body dispensing end to a body pedal end;

a body window located near the body dispensing end of the body through which at least part of a dispensing object is accessible;

a footing attached to the body at the body pedal end;

a pedal operatively installed to the body at the body pedal end via a fulcrum member;

a platform located within the body to receive the dispensing object;

an actuation rod located within the body and extending from the pedal to the platform, wherein movement of the actuation rod via operation of the pedal results in movement of the platform;

a spring located between the pedal and the footing;

wherein the pedal is manipulable between a pedal disengaged position and a pedal engaged position;

wherein the pedal is moved at least partially to the pedal engaged position via a pedal force applied to the pedal that is greater than a spring force;

wherein the pedal returns to the pedal disengaged position when the pedal force is less than the spring force;

wherein the pedal comprises a pedal fulcrum member receiving interface;

wherein the pedal pivots about the fulcrum member operatively installed to the body via the pedal fulcrum member receiving interface; and wherein the platform comprises a platform bottom bracing member installed to a platform actuation rod receiving interface of the platform to increase durability.

16. The fluid dispensing apparatus of claim 15, further comprising:

a container positioned in proximity to the dispensing object such that movement of the platform operates the dispensing object via compression.

17. The fluid dispensing apparatus of claim 16, further comprising:

a container lid comprising a container lid dispensing interface through which container contents held by the container are selectively taken from the container.

18. A method of dispensing a fluid via a fluid dispensing apparatus comprising a body extending from a body dispensing end to a body pedal end and a pedal operatively installed to the body at the body pedal end, the method comprising:

(a) at least partially pivoting the pedal about a fulcrum member;

(b) moving an actuation rod located within the body and extending from the pedal to a platform via operation of the pedal;

(c) moving the platform located within the body, the platform being configured to receive a dispensing object to be moved with the platform;

(d) actuating at least part of the dispensing object to dispense a fluid through a body window located near the body dispensing end of the body through which at least part of the dispensing object is accessible;

wherein a footing is attached to the body at the body pedal end;

wherein the dispensing object is removably installable to the platform;

wherein the container lid comprises a container lid locking pin;

wherein the body comprises a body locking pin receiver located near the body dispensing end to selectively receive the container lid locking pin; and the method further comprising:

(e) at least partially rotating the container locking pin located in the body locking pin receiver to reversibly lock the container lid to the body.

* * * * *